US009516928B2

(12) United States Patent
Catheline et al.

(10) Patent No.: US 9,516,928 B2
(45) Date of Patent: Dec. 13, 2016

(54) WATCH STRAP STRIP

(75) Inventors: Adrien Catheline, Valleiry (FR); Félix Grasser, Grand-Lancy (CH); Frédéric Oulevey, Saint-George (CH)

(73) Assignee: ROLEX SA, Geneva (CH)

( * ) Notice: Subject to any disclaimer, the term of this patent is extended or adjusted under 35 U.S.C. 154(b) by 265 days.

(21) Appl. No.: 14/004,740

(22) PCT Filed: Apr. 5, 2012

(86) PCT No.: PCT/CH2012/000080

§ 371 (c)(1),
(2), (4) Date: Nov. 4, 2013

(87) PCT Pub. No.: WO2012/135967

PCT Pub. Date: Oct. 11, 2012

(65) Prior Publication Data

US 2014/0053602 A1 Feb. 27, 2014

(30) Foreign Application Priority Data

Apr. 6, 2011 (CH) ..... 620/11
Apr. 7, 2011 (EP) ..... 11405241

(51) Int. Cl.
*A44C 5/00* (2006.01)
*A44C 5/14* (2006.01)

(52) U.S. Cl.
CPC ..... *A44C 5/00* (2013.01); *A44C 5/0053* (2013.01); *A44C 5/14* (2013.01)

(58) Field of Classification Search
CPC ..... A44C 5/00; A44C 5/0053; A44C 5/14; A44C 5/142
See application file for complete search history.

(56) References Cited

U.S. PATENT DOCUMENTS 2,573,055 A 10/1951 Pedersen
3,543,975 A 12/1970 Bauer
3,610,488 A * 10/1971 Tracy ..... A44C 5/00 224/171
3,844,136 A * 10/1974 Rieth ..... A44C 5/025 224/173
3,889,323 A * 6/1975 Reith ..... A44C 5/14 224/177

(Continued)

FOREIGN PATENT DOCUMENTS

AT 400551 B 1/1996
AT 407692 B 5/2001

(Continued)

OTHER PUBLICATIONS

International Search Report for PCT/CH2012/000080, Mailing Date of Jul. 10, 2013.

(Continued)

*Primary Examiner* — Brian D Nash

(74) *Attorney, Agent, or Firm* — Westerman, Hattori, Daniels & Adrian, LLP

(57) ABSTRACT

The invention relates to a watch strap strip (1) reinforcement (2) intended to be housed in a casing (3) of the strip made from a flexible material, wherein the reinforcement includes a linking element (4) mechanically connecting: an element (10) for fixing the strip to the watch case to an element (9) for fixing the strip to a closure element.

30 Claims, 7 Drawing Sheets

(56) References Cited

U.S. PATENT DOCUMENTS

| | | | | | |
|---|---|---|---|---|---|
| 3,924,418 | A * | 12/1975 | Burkle, Jr. | A44C 5/107 | 224/164 |
| 4,573,221 | A | 3/1986 | Hirsch | | |
| 4,821,532 | A * | 4/1989 | Jaques | A44C 5/025 | 224/178 |
| D333,446 | S * | 2/1993 | Butler | D11/19 | |
| 5,365,753 | A * | 11/1994 | Carrola | A44C 5/027 | 59/80 |
| 5,812,500 | A * | 9/1998 | Webb, Jr. | A44C 5/0053 | 368/10 |
| 6,406,177 | B1 | 6/2002 | Fukushima et al. | | |
| 6,968,671 | B2 * | 11/2005 | Dal Monte | A44C 11/00 | 29/896.411 |
| 7,013,631 | B2 * | 3/2006 | Carrola | A44C 17/0258 | 59/4 |
| 7,107,790 | B2 * | 9/2006 | Frank | A44C 5/14 | 224/164 |
| 8,870,448 | B2 * | 10/2014 | Bianco | A44C 5/00 | 224/174 |
| 2007/0067967 | A1 * | 3/2007 | Sima | A44C 5/147 | 24/265 WS |

FOREIGN PATENT DOCUMENTS

| | | | |
|---|---|---|---|
| CA | 1217062 | A | 1/1987 |
| CH | 502787 | A | 2/1971 |
| CH | 650891 | A | 8/1985 |
| CH | 655220 | A | 4/1986 |
| DE | 1806449 | A1 | 6/1969 |
| DE | 2061849 | A1 | 7/1972 |
| EP | 0116384 | A1 | 8/1984 |
| EP | 0133181 | A1 | 2/1985 |
| EP | 1023851 | A1 | 8/2000 |
| FR | 1591988 | A | 5/1970 |
| JP | 51-41476 | U | 3/1976 |
| JP | 52-143066 | A | 11/1977 |
| JP | 59-144405 | A | 8/1984 |
| JP | 59-141809 | U | 9/1984 |
| JP | 60-91013 | U | 6/1985 |
| JP | 61-123723 | U | 8/1986 |
| JP | 63-161515 | U | 10/1988 |
| JP | 01-236004 | A | 9/1989 |
| JP | 07-329110 | A | 12/1995 |
| JP | H-11239506 | A | 9/1999 |
| JP | 2000-300313 | A | 10/2000 |
| KR | 2006-0090648 | A | 8/2006 |

OTHER PUBLICATIONS

Swiss Search Report dated Jul. 12, 2011, issued in Swiss Application No. CH00620/1; w/ English Translation (4 pages).

Notification of Reasons for Refusal dated Nov. 17, 2015 issued in counterpart Japanese application No. 2014-502967 (w/ English translation, 14 pages).

* cited by examiner

WATCH STRAP STRIP

The invention relates to a watch strap strip reinforcement. The invention also relates to a strip for a strap including such a reinforcement. The invention further relates to a strap including at least one such strip. The invention relates, finally, to a watch including at least one such strip.

Numerous flexible watch straps are commercially available, especially made from leather, elastomer or thermoplastic-elastomer. However, the durability and the performance of straps of this type are not always satisfactory in comparison with the performance of a metallic link bracelet.

In order to address these problems, consideration has been given to producing straps of the hybrid type, that is to say flexible straps having reinforcements.

A strap made from a plastic material reinforced by a metallic fitting which is folded back at the extremities of the strip in such a way as to form holes permitting the passage of the bars is known, for example, from document FR1591988. The purpose of this folding-back of the metallic fitting is to form a through hole for the passage of a bar or a screw for fixing the strap. The tensile strength of the strap is ultimately assured by the plastic material.

Known from document AT400551 is a strap in which a two-layer reinforcement formed from a resistant thread glued to a flexible blade is implemented in order to increase the tensile strength of the strips without impairing the flexibility of the strap. This two-layer reinforcement does not improve the tensile behavior at the level of the attachments.

Known from document AT407692 is a flexible strap with a reinforcement that is present solely at the fold of the strip and is glued in order to reinforce the strap at the level of the attachment. The tensile strength of the strip is not improved by this solution.

Known from document JP07329110A is a flexible strap made from resin reinforced by a nylon insert. This insert is wound around the attachments in certain configurations. As in document FR1591988, the tensile strength of the strap is assured by the resin.

Numerous models and designs of flexible straps have been described and presented. Nevertheless, the familiar flexible straps are all rather inefficient mechanically, especially at the level of the tensile strength of the strips. It is thus necessary to make a choice between a flexible strap made from leather or elastomer, which is comfortable, and a mechanically efficient metal bracelet. Flexible straps are invariably known to be less robust than metal bracelets, for example at the level of their tensile strength or bending strength.

The object of the invention is also to make available a strap overcoming the disadvantages mentioned previously and improving the straps that are already familiar from the prior art. In particular, the invention proposes an efficient and comfortable strap. The invention also proposes a watch including such a strap.

A reinforcement according to a first aspect of the invention includes a linking element mechanically connecting or mechanically securing:

an element for fixing the strip to a watch case, to an element for fixing the strip to a closure element.

Various embodiments of the reinforcement according to the invention are as follows:

The linking element includes a blade, especially a metallic blade, and in particular a metallic blade made from a superelastic alloy.

The element for fixing the strip to the watch case is made from a superelastic alloy and/or the element for fixing the strip to the closure element is made from a superelastic alloy.

The element for fixing the strip to the watch case includes a tube and/or the element for fixing the strip to the closure element includes a tube.

The linking element has a cross-section of which the geometry, in particular the width of the cross-section and/or the thickness of the cross-section, changes along the strip or the reinforcement.

The linking element forms at least one part of the element for fixing the strip to the watch case, especially a loop, and/or the linking element forms at least one part of the element for fixing the strip to the closure element, especially a loop.

The linking element includes an extremity that is folded and fixed to the linking element at the level of the element for fixing the strip to the watch case and/or the linking element includes an extremity that is folded and fixed to the linking element at the level of the element for fixing the strip to a closure element.

The folded extremity of the linking element at the level of the element for fixing the strip to the watch case is fixed to the linking element by riveting and/or soldering and/or screwing, and/or the folded extremity of the linking element at the level of the element for fixing the strip to the closure element is fixed to the linking element by riveting and/or soldering and/or screwing.

The linking element is fixed directly to the element for fixing the strip to the watch case, and/or the linking element is fixed directly to the element for fixing the strip to the closure element, for example being fixed by soldering or brazing.

The linking element is fixed directly at its extremity to the element for fixing the strip to the watch case and/or to the element for fixing the strip to the closure element.

A reinforcement according to a second aspect of the invention includes a blade made from a superelastic alloy, the blade extending from an element for fixing the strip to a watch case to an element for fixing the strip to a closure element.

A reinforcement according to a third aspect of the invention includes a blade having a cross-section of which the geometry, in particular the width of the cross-section and/or the thickness of the cross-section, changes along the strip, the blade extending from an element for fixing the strip to a watch case to an element for fixing the strip to a closure element, the geometry changing along the strip or the reinforcement in such a way that the flexural rigidity of the strip, along the strip, has a predetermined profile, in particular a profile that is constant over at least a part of the strip, for example over the half of the strip close to the closure element.

Various embodiments of the reinforcement according to the invention are as follows:

The blade is a metallic blade, in particular a metallic blade made from a superelastic alloy.

The element for fixing the strip to the watch case is made from a superelastic alloy and/or the element for fixing the strip to the closure element is made from a superelastic alloy.

The element for fixing the strip to the watch case includes a tube and/or the element for fixing the strip to the closure element includes a tube.

The blade has a cross-section of which the geometry, in particular the width of the cross-section and/or the thickness of the cross-section, changes along the strip or the reinforcement.

The blade forms at least one part of the element for fixing the strip to the watch case, especially a loop, and/or the blade forms at least one part of the element for fixing the strip to the closure element, especially a loop.

The blade includes an extremity that is folded and fixed to the blade at the level of the element for fixing the strip to the watch case, and/or the blade includes an extremity that is folded and fixed to the blade at the level of the element for fixing the strip to a closure element.

The folded extremity of the blade at the level of the element for fixing the strip to the watch case is fixed to the blade by riveting and/or soldering and/or screwing, and/or the folded extremity of the blade at the level of the element for fixing the strip to the closure element is fixed to the blade by riveting and/or soldering and/or screwing.

The blade is fixed directly to the element for fixing the strip to the watch case and/or the blade is fixed directly to the element for fixing the strip to the closure element, for example being fixed by soldering or brazing.

The blade is fixed directly at its extremity to the element for fixing the strip to the watch case or to the element for fixing the strip to the closure element.

The linking element or the blade is of a nature such that it prevents the element for fixing the strip to the watch case from being separated from the element, other than by breaking the linking element or the blade, for the purpose of fixing the strip to the closure element, under a tensile load of 50 N, or 100 N or 200 N.

A strap strip according to the invention includes a reinforcement as above and a casing especially a casing made from an elastomer material.

Various embodiments of the strap strip according to the invention are as follows:

The casing includes at least one opening revealing the reinforcement.

The casing is molded onto the reinforcement.

The inertias and/or the geometries of the sections of the linking element, especially of the reinforcement, and/or of the casing, change along the strip or the reinforcement in such a way that the flexural rigidity of the strip, along the strip, has a predetermined profile, in particular a profile that is constant over at least a part of the strip, for example over the half of the strip close to the closure element.

Characteristic values for the inertias and/or the geometries of the sections of the linking element or the blade and the casing change along the strip or the reinforcement in opposite directions.

A strap according to the invention includes at least one strap strip as above.

A watch according to the invention includes at least one strap strip as above.

A method for determining a geometry of a strap strip according to the invention includes the following stages:

define a profile for the change in the flexural rigidity of the strip along the strip;

define a casing material and the dimensions of this casing;

select the thickness of the reinforcement and the width of the reinforcement, respectively;

calculate the width of the reinforcement and the thickness of the reinforcement, respectively, in such a way that the flexural of the strip, along the strip, changes according to the predetermined profile.

The accompanying drawing depicts, by way of example and without limitation, two embodiments of a strap according to the invention.

Figure 15:
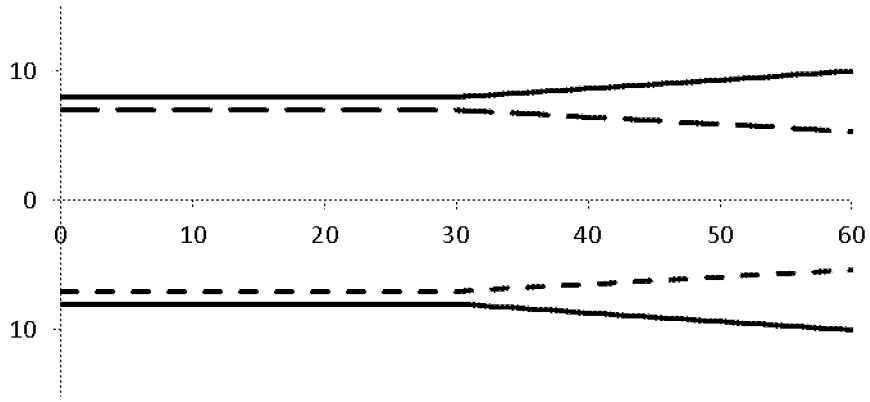
Figure 16:
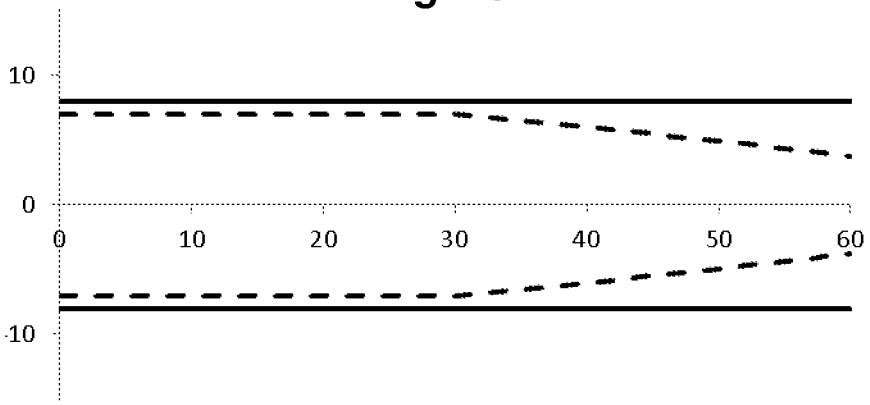
Figure 17:
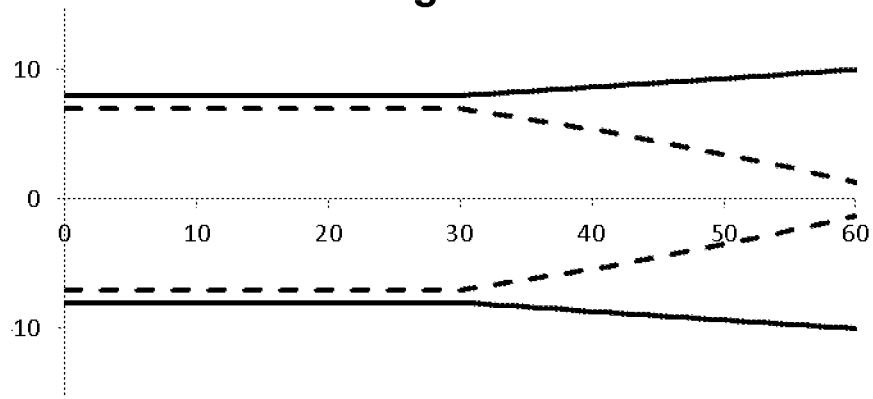

FIGS. 15 to 17 are graphics depicting the variations in the width of the reinforcement (broken line) required in order to obtain a constant rigidity along the strip and thereby to compensate for the variations in the width of the strip (solid line, FIGS. 15 and 17) or in the thickness of the strip (not depicted, FIGS. 16 and 17). The figures correspond to a top view of the form of the strip, the scales being graduated in [mm].

One embodiment of a strap strip 1 according to the invention is described below with reference to FIGS. 1 to 13. The strap strip is of the flexible type, in particular the hybrid type, that is to say it is made from a flexible material but including a reinforcement.

The strap strip includes a reinforcement 2 inserted into a casing made from a flexible material. The reinforcement is preferably made from a first material, and the casing 3 is made from a second material. For example, the first material is metallic, especially an alloy, in particular being a superelastic alloy or a shape-memory alloy. The second material is flexible. An elastomer such as rubber, a polymer or leather are particularly suitable for use as a second material.

The properties of the first and second materials are distinct in order to separate the stresses as effectively as possible. Preferably produced is a strip of which the architecture is based on a central core or reinforcement and a casing applied around the core, that is to say coating the core at least partially. The reinforcement allows high levels of mechanical strength of the strip to be assured, especially in respect of its tensile behavior (high strength) and its deformation behavior under stress (low deformation). In addition or alternatively, the reinforcement allows high levels of mechanical resistance of the strip to bending to be assured. The actual casing (or coating of the strip) surrounding the reinforcement at least partially allows functions of comfort and aesthetics to be assured in principal, especially by allowing a desired flexibility and/or a desired lightness and/or a desired geometry to be achieved. The casing is preferably molded onto the reinforcement, especially when it is made from an elastomer material. The casing may also be assembled by gluing and/or by stitching around the reinforcement when it is made from leather.

In both cases, an opening 30 may be made in the casing in order to reveal the reinforcement 2. The visible part of the reinforcement may then be treated in order to avoid any deterioration of it. The opening may perform an aesthetic function and/or the function of revealing the technical nature of the strap strip.

The reinforcement includes an element 6 for fixing the strip to the watch case and an element 5 for fixing the strip to a closure element. The reinforcement includes a linking element 4 mechanically connecting the element 6 for fixing the strip to the watch case to the element 5 for fixing the strip to a closure element. Preferably, the element 6 for fixing the strip to the watch case includes a tube 10 and/or the element 5 for fixing the strip to the closure element includes a tube 9. Alternatively, the element 6 for fixing the strip to the watch case is realized by a first extremity of the linking element, and/or the element 5 for fixing the strip to a closure element is realized by a second extremity of the linking element. The reinforcement 2 principally includes a blade 4, especially a metallic blade, and in particular a blade made from a superelastic metallic alloy.

The element 6 for fixing the strip to the watch case is intended to interact with a second fixing element provided for securing the strip to the watch case, especially to the horns. The first and second elements constitute an attachment. In a similar manner, the element 5 for fixing the strip to a closure element is intended to interact with a second fixing element provided for securing the strip to the closure element, which in particular may be a buckle or a clasp, for example a deployant clasp. The first and second elements constitute an attachment.

As depicted especially in FIGS. 2, 4, 5, 12 and 13, the element 6 for fixing the strip to the watch case and/or the element 5 for fixing the strip to a closure element is realized by means of a tube assembled on the blade 4 by soldering or brazing 19. The tube 9 and/or 10 may also have an excess thickness and/or a groove intended to receive the extremity of the blade and to facilitate and/or improve the performance of the soldering or brazing. The tube depicted in FIG. 12 has a groove to receive the blade 4.

A bar, a screw or a pin, constituting the second fixing element, is then engaged in each tube 9 and/or 10 in order to fix the strip to the watch case or to the closure element.

The presence of the tubes 9 and 10 principally permits the two extremities of the reinforcement to be secured to the second fixing elements, thereby absorbing the tensile forces in an optimal manner. These tubes provide three additional advantages:

- to facilitate positioning in a mold in the event that the casing is molded subsequently onto the reinforcement;
- to facilitate the introduction of the bar, screw or pin; it is, in fact, easy to introduce a rod into a perfectly circular tube;
- to control precisely the length of the strip or the distance (center distance) between the two pins of the strip/closure and strip/watch case attachments.

The tubes are selected preferably in the same material as the material of the metallic blade constituting the reinforcement. In particular, when the material of the blade is a superelastic metallic alloy, especially an NiTi alloy, the material of the tubes is preferably a superelastic metallic alloy, and more preferably the same superelastic alloy as that utilized for the blade, especially an NiTi alloy. This advantageous combination permits a robust assembly of the tubes to the extremities of the blade. The assembly of the tubes to the extremities of the blade is preferably achieved by soldering, the soldering being more preferably of the laser type. The recommended assembly by laser soldering permits the localized fusion of the material thereby securing the extremity of the blade and the tube, without the addition of material from outside, while ensuring excellent mechanical performance and good resistance to corrosion. The dimensions of the tubes typically exhibit an external diameter comprised between 1 and 2.5 mm. The tube 10 for the watch case/strip attachment is preferably provided with notches 101 for avoiding degradation of the casing during the use of bar pliers to assemble the strip on the case middle.

Alternatively, tubes made from Phynox, Nivaflex or an equivalent material could also be utilized, with the associated risk that the assembly of the tubes to the extremities of the blade is more difficult to achieve.

The passage of the bar pliers can also be reduced to a strict minimum, and the elasticity of the casing can also be used to compress the bar. In this case, the tube 10 for attachment to the watch case must be much shorter in order to permit this compression.

Figure 3:
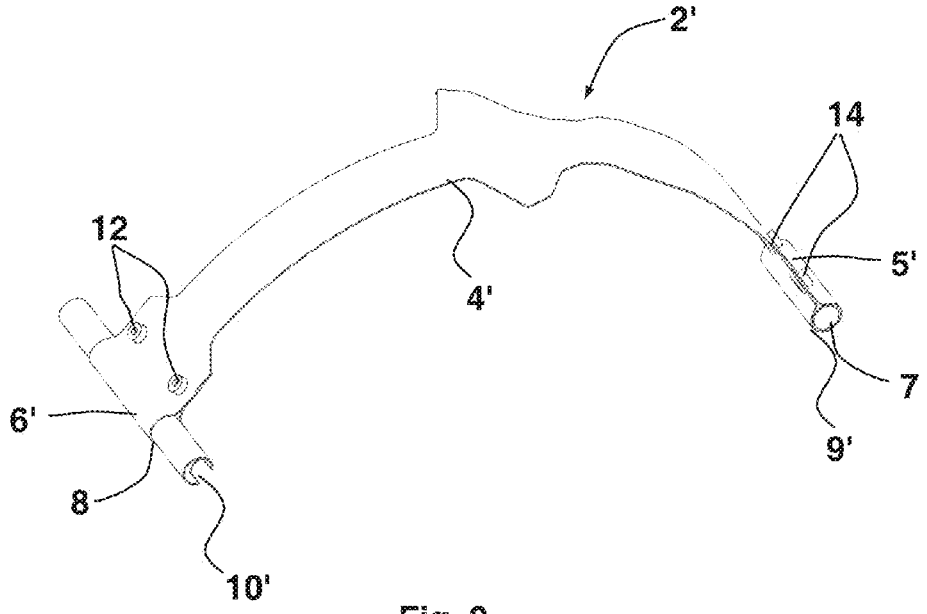
FIG. 3 is a perspective view of a second embodiment of a reinforcement utilized in an embodiment of the strap strip according to the invention.
Figure 4:
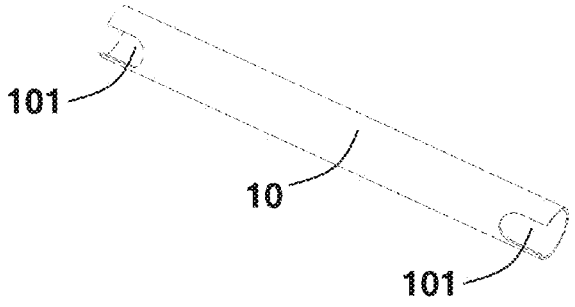
FIG. 4 depicts a view of an embodiment of a tube utilized in an embodiment of the strap strip according to the invention at the level of the attachment to the watch case.
Figure 5:
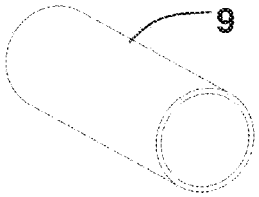
FIG. 5 is a view of an embodiment of a tube utilized in an embodiment of the strap strip according to the invention at the level of the attachment to a closure element.
Figure 6:
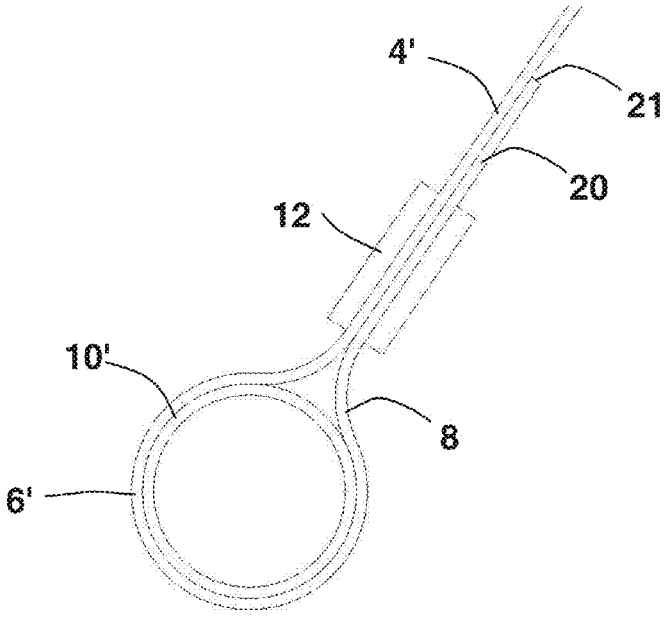
FIG. 6 is a partially sectioned view of one extremity of the reinforcement according to the second embodiment of a reinforcement according to the invention.

In a second embodiment of the reinforcement 2' depicted in FIGS. 3 and 6, the element 6' for fixing the strip to the watch case and/or the element 5' for fixing the strip to a closure element is realized by bending the extremity of the blade 4'. In fact, the first extremity is bent to form a passage 8 or a loop, and a part 20 of the extremity is folded back onto the blade 4'. This folded-back part 20 or fold is fixed to the blade, especially by riveting. In order to do this, the blade and the fold have holes intended to come into alignment with one another and to receive rivets 12. The second extremity of the blade is preferably configured in the same manner in order to produce a passage 7 or a loop, the blade and the fold having holes intended to come into alignment with one another and to receive rivets 14.

In order to ensure the performance of the strip, the reinforcement must be connected to the attachments while preserving its performance as far as possible. The riveted fold at each extremity permits the provision of a passage for a bar, a screw or a pin intended for the securing of the strip.

Advantageously, as depicted in FIGS. 3 and 6, a tube 10' may be positioned in the passage 8, and/or a tube 9' may be positioned in the passage 7 produced at the other extremity of the reinforcement. The reinforcement may thus be folded back around the one or more tubes. A bar, a screw or a pin, constituting the second fixing element, is then engaged in each tube in order to fix the strip to the watch case or to the closure element. The tubes 9' and/or 10' are optional, since the bars, screws or pins could engage directly in the passages 7 or 8 in the absence of a tube. Nevertheless, the presence of tubes is preferred.

The selected tubes are preferably made from Phynox, Nivaflex, superelastic alloy or an equivalent material, which permits good mechanical performance to be assured on the one hand and good resistance to corrosion on the other hand.

The dimensions of the tubes typically exhibit an external diameter lying between 1 and 2.5 mm. The tube 10' for the watch case/strip attachment is preferably provided with notches 101 for avoiding degradation of the casing during the use of bar pliers to assemble the strip on the case middle.

Tests have shown that a rivet made from brass or stainless steel is ideally suited to the desired application. Alternatives other than riveting are conceivable in order to achieve the desired performance. For example, it is possible to staple the fold 20 to the rest of the blade. It is also possible to attach the fold 20 to the rest of the blade by soldering performed, for example, at the extremity of the fold 20. In this case, the soldering may preferably be of the laser type. It is also possible to secure the fold 20 to the rest of the blade by screwing. In this case, bolts are utilized in place of the rivets.

The first and second embodiments may be combined on the same reinforcement, with the first embodiment at a first extremity and the second embodiment at a second extremity.

It should be noted that the solutions that are familiar from the prior art are not satisfactory. A simple fold, as in document FR1591988, improves the tensile behavior only marginally. In fact in this document, unlike the invention, it is the elastomer overmolding that permits the strength of the attachment to be assured in this case.

In the invention, the reinforcement which permits the element for fixing the strip to the watch case to be connected mechanically to the element for fixing the strip to the closure element is realized first. Thus, at this stage of realization, the application of a mechanical tensile loading of 50 N, or 100 N or 200 N to the reinforcement does not permit the deformation of the reinforcement and the fixing element, as is the case in the prior art. In particular, the application of a mechanical tensile loading to a pin or a bar that is present in the tube 9 or 10 does not permit the tube or the other element to be released from the reinforcement, other than by breaking the reinforcement. Thus, in the described embodiments, the elements for fixing the attachments (permitting fixing to the watch case or to the closure) are secured to the reinforcement.

The principal role of the reinforcement 2 is to ensure the mechanical strength of the strip. Having regard for the requirement to have a flexible strap and for the criterion of resistance to the various efforts, the reinforcement principally includes a leaf or a metal blade 4. In particular, the use of a metallic superelastic alloy also permits the flexural rigidity to be improved.

In order to guarantee that strong deformations of the strip do not give rise to permanent deformation, for example when the strip is folded back on itself through 180°, a superelastic alloy is utilized advantageously for the reinforcement. Superelasticity is apparent in certain highly specialized alloys, which demonstrate a transition between an austenitic phase and a martensitic phase. The superelasticity is characterized by the complete recovery of the form of the sample when the applied stress ceases. In the range of temperatures within which the austenicity is stable, the martensitic transformation may be brought about under stress. The stress is first exerted in the range of elastic deformation of the austenite at a level of stress proportional to the deformation. Above a critical value, the austenite is transformed into martensite. When the stress ceases, total reversion of the martensite to austenite takes place to the point of zero deformation, since it is the austenite structure that is stable at the temperature at which the stress is applied. The great relevance of this property is the major possibility of deformation in an "elastic" range when the stress varies. The elasticity of these alloys may reach ten times that of steel.

There are several alloys which possess superelastic properties. It is possible to utilize an alloy based on nickel and titanium, NiTi (commercial name Nitinol), for example, principally because this alloy has excellent resistance to corrosion and is biocompatible. Other superelastic alloys, such as CuAlBe, CuAlNi or CuZnAl alloys, can also be utilized.

Tests have confirmed that the reinforcement made from NiTi alloy and, in particular, that a blade made from NiTi assembled by laser soldering to the tubes made from NiTi alloy, possesses excellent mechanical strength and corrosion resistance, even under unfavorable conditions (combination of materials favoring the equivalent of galvanic corrosion and prestressing of the metallic blade), after two months' testing in a saline mist.

The blades utilized can have an initial zero curvature, and the curvature of the strip may be obtained during molding of the casing. It is also conceivable to impart an initial curvature (preform) to the blade by the use of a suitable manufacturing process.

Since the invention makes it possible to separate, at least up to a point, the contributions to the functions of "mechanical strength" and "aesthetics/comfort", the reinforcement may be designed without taking account of the casing. It is obvious that the addition of a casing further improves the tensile strength.

Figure 7:
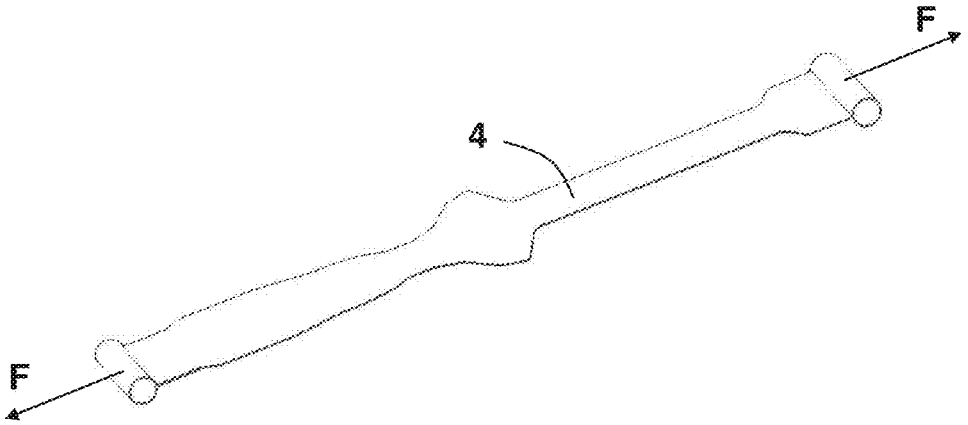
FIG. 7 is a perspective view of the first embodiment of a reinforcement utilized in an embodiment of the strap strip according to the invention.

Standard NIHS 92-11 states that a watch strap must be capable, as illustrated in FIG. 7, of withstanding a tensile force F of 200 N per strip without breaking (permanent deformation is tolerated). These provisions may be increased, in which case breaking of the strap will be assured by the shear failure of the bar pivots.

The reinforcement is then dimensioned according to the maximum tensile force F which the strip must be able to withstand without breaking, by estimating the stresses equivalent to the maximum force, which must be lower than the elastic limit of the material. For the dimensions utilized in the context of the tests, with a minimum width of 7.4 mm, a thickness of 0.1 mm for the blade will permit a limit force of 440 N before plastic deformation to be obtained, which is well above the desired values and well below the elastic limit and the ultimate tensile strength of the material.

In addition, simulations and tests have shown that the stress concentrations generated in the vicinity of soldering or rivets remain below the ultimate plastification stress, even for an applied tensile force greater than 300 N. The tests have also shown that such a configuration permits a level of performance that is largely sufficient to meet the requirements of standard NIHS 92-11, which specifies the threshold tensile strength values. The strengths in lateral deviation and in traction are also within the permissible criteria.

In addition, the thickness of the casing may be selected in such a way as to optimize the flexural rigidity of the strip. For a blade thickness of 0.1 mm, the permissible radius of curvature is 0.7 mm (by comparison, a central stainless steel blade (type 1.4310) tolerates a minimum radius of curvature of 5 mm only). The thickness of the coating of the strap is then selected in such a way as to provide a radius of curvature greater than the permissible limit in the event of the strip being folded through 180°.

The NiTi alloy loses its superelastic properties below 0° C. However, the alloy regains all its properties as soon as the temperature rises above this limit. Thus, a blade that is bent with a radius of 2 mm at −16° C. will retain this curvature for as long as the temperature remains below 0° C., but will once again become perfectly straight as soon as the temperature becomes higher (resumption of form in 8 s at 20° C.). Similarly, the blade made from superelastic alloy retains all its superelastic properties following coating (overmolding conditions: typically T>180° C. for several minutes). This temperature-related behavior may vary depending on the selected superelastic alloy. Thus, certain alloys are suitable for use at a lower temperature, although with an associated decrease in the maximum operating temperature.

Figure 1:
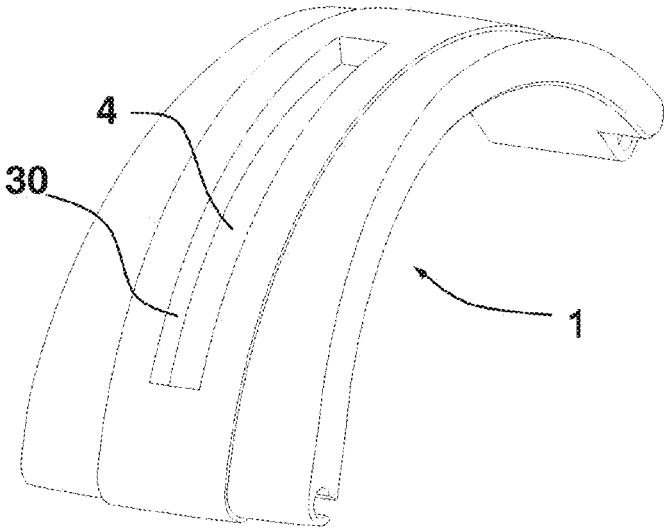
FIG. 1 is a perspective view of an embodiment of a strap strip according to the invention.
Figure 2:
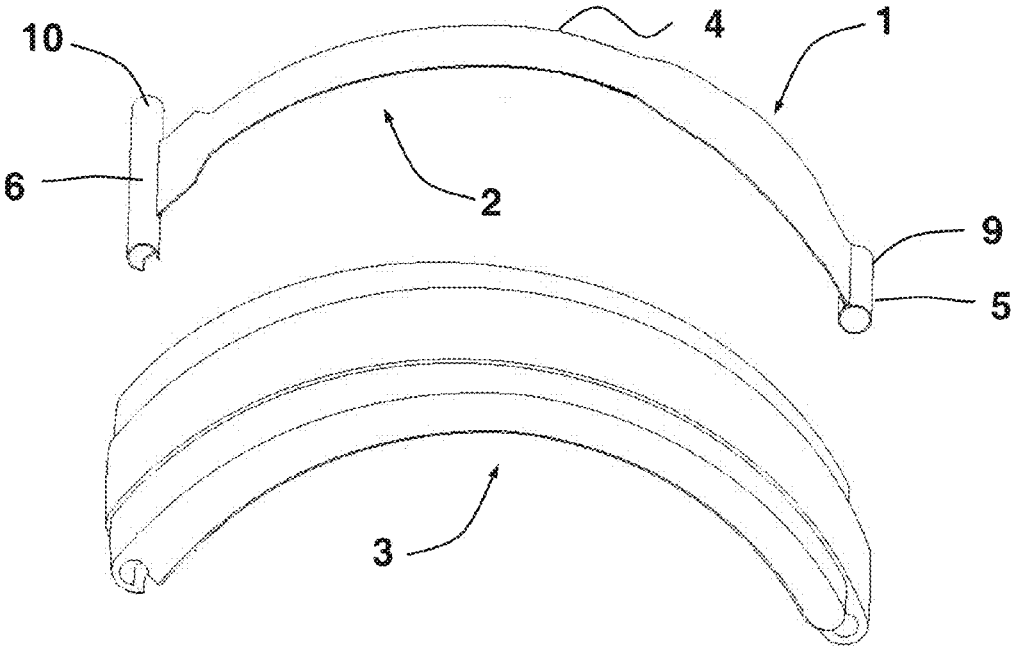
FIG. 2 is an exploded view of an embodiment of the strap strip according to the invention, also illustrating a first embodiment of the reinforcement utilized in the embodiment of the strap strip according to the invention.

The blades depicted in FIGS. 2, 3 and 7 to 11 have a complex form, with a lateral section which varies along the strip. This permits fine adjustment of the rigidity and the flexibility of the strap along the strip. In fact, the flexibility of the strip varies in a significant manner if the thickness of the strip and/or its width vary, and/or if an opening 30 is cut into the strip for an aesthetic reason or for comfort. In the case of a complex strap strip, as depicted in FIG. 1, these variations in flexibility may interfere with the wearing of the watch and may impair its tactile appreciation. The approach is to compensate for the variation in the flexural modulus (Young's modulus times the inertia about the neutral axis of the metallic core) of the casing by varying the inertia of the blade, in particular its width. The aim is to ensure a predefined flexibility for the strip along the length of the strip, and especially a flexibility that remains constant for the entire length of the strip or, failing that, for a section of the strip, especially in the vicinity of the closure element, since it is in this region that the radius of curvature of the wrist varies most. Preferably, the thickness of the blade does not vary along the blade.

Figure 8:
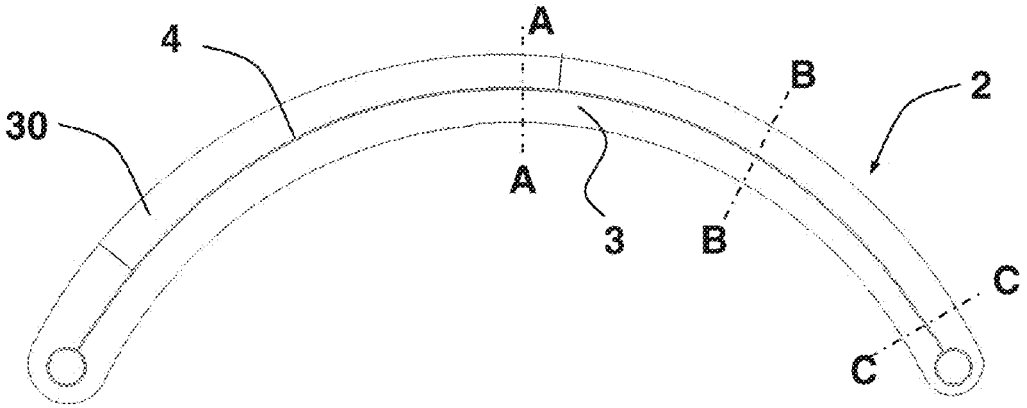
FIG. 8 is a view in longitudinal cross-section of the first embodiment of a reinforcement utilized in an embodiment of the strap strip according to the invention.
Figure 9:
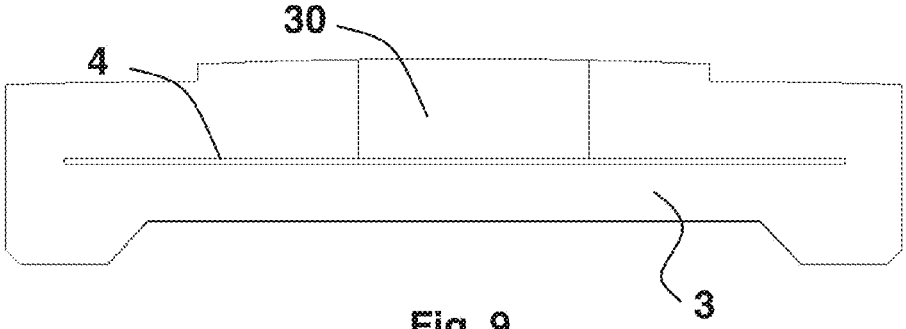
FIGS. 9 to 11 are cross-sectional views of the embodiment of a reinforcement utilized in the embodiment of the strap strip according to the invention illustrated in FIG. 8.
Figure 10:
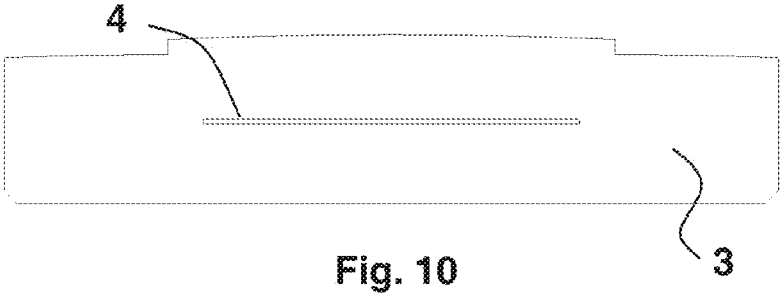
Figure 11:
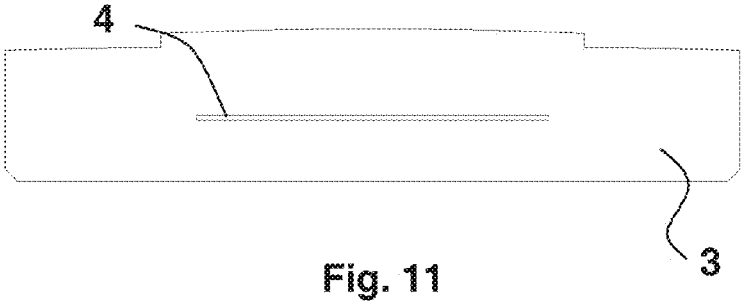
Figure 12:
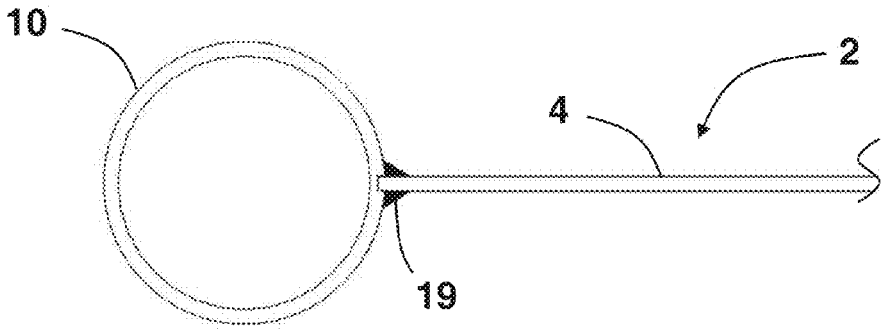
FIGS. 12 and 13 are partially sectioned views of one extremity of two variants of the first embodiment of a reinforcement according to the invention illustrated in FIG. 2.
Figure 13:
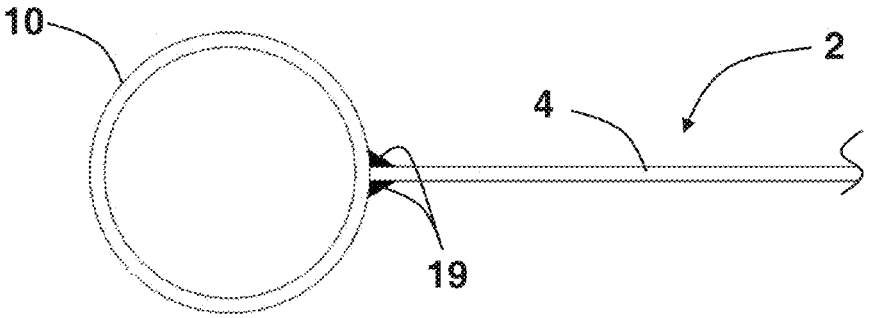

In order to illustrate this in the case of a complex casing geometry, reference is made to FIGS. 8 and 9 to 11. FIG. 9 is a cross-section at the level of the plane A-A in FIG. 8, FIG. 10 is a cross-section at the level of the plane B-B in FIG. 8, and FIG. 11 is a cross-section at the level of the plane C-C in FIG. 8. It should be noted that the geometries of the cross-section of the strip are different at the level of these three planes. In fact, the geometry of the section of the casing 3 and/or the geometry of the section of the reinforcement 4 changes along the strip. In particular, the cross-section of the casing changes in order to ensure aesthetic functions, and the cross-section of the reinforcement changes in order to ensure a mechanical function, especially a mechanical function linked to comfort. FIG. 9 likewise shows an opening 30. This architecture makes it possible to have constant flexibility of the strip, in particular on the section of the strip close to the closure element, and to compensate for any variations in rigidity attributable to the presence of an opening or, more generally, attributable to variations in the cross-section of the casing.

Figure 14:
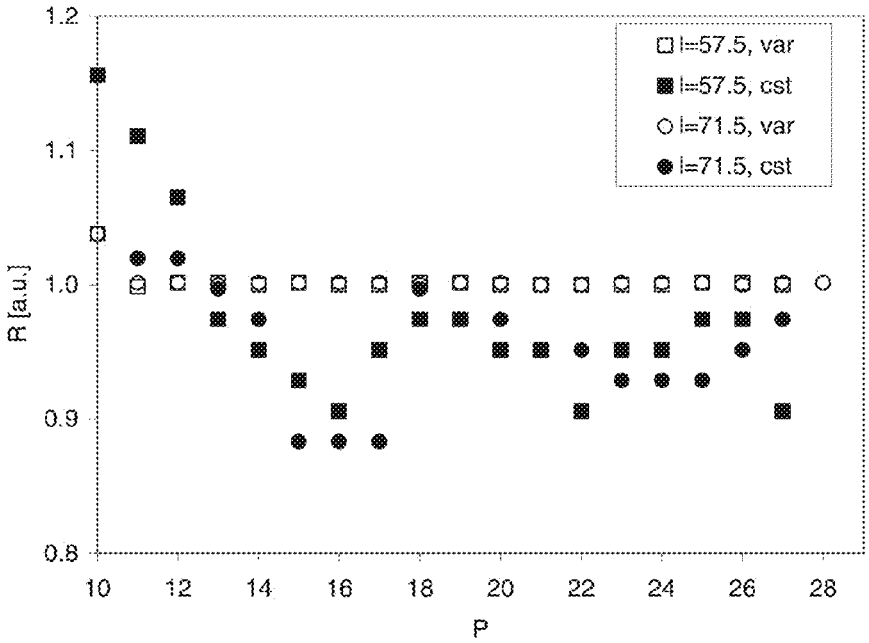
FIG. 14 is a graphic representing the variations in the flexural rigidity of various embodiments of strap strips according to the invention.

Thanks to such an architecture, an in particular thanks to the variation in the cross-section of the reinforcement along the strip, it is possible to obtain a desired profile for the flexibility of the strip along the latter. The graphics in FIG. 14 illustrate these profiles. The points shown indicate the bending strength or the flexibility of the strap at different positions of the strip for four types of strip, specifically:

- a strip with a length of 57.5 mm having a reinforcement of constant cross-section (l=57.5, cst);
- a strip with a length of 57.5 mm having a reinforcement of variable cross-section (l=57.5, var);
- a strip with a length of 71.5 mm having a reinforcement of constant cross-section (l=71.5, cst);
- a strip with a length of 71.5 mm having a reinforcement of constant cross-section (l=71.5, var).

The strips having a variable reinforcement cross-section are optimized to ensure a constant rigidity for the entire length of the strip with a nominal value equal to 1 on the y-axis. It can be appreciated that the variable cross-section of the reinforcement makes it possible to compensate to a very large extent for the effects of the variations in the cross-section of the casing: between points 10 and 28, the variation between the minimum and maximum rigidity values falls from more than 25% for a reinforcement with a constant cross-section to 4% for a reinforcement with a variable cross-section, which is no longer perceptible. In the graphic in FIG. 14, the points 14, 21 and 28 on the x-axis correspond approximately to the locations of the profiles A-A, B-B and C-C in FIGS. 8 to 11.

FIGS. 15 to 17 illustrate the possibilities offered by the controlled variation of the dimensions of the blade in a more simple case, and illustrate the process of designing the blade. The strap strip is made up of a reinforcement having a modulus of elasticity $E_r$ and a casing made from a material having a modulus $E_e$. The flexural rigidity of a strip made from a single material is proportional to the product of the modulus of elasticity and the inertia of the cross-section. In the case of a strap strip according to the invention, as an initial approximation the rigidity of the strip will be proportional to $(E_r \times I_r + E_e \times I_e)$, where $I_r$ and $I_e$ respectively represent the inertia of the cross-section of the reinforcement and of the casing. This approximation is valid if the cross-section rotates about the neutral fiber of the reinforcement, which is reasonable given that, in general, $E_r >> E_e$. In this general case, it is thus the reinforcement that "imposes" the position of the axis of rotation of the cross-section of the casing, which then coincides with or is very close to the neutral fiber of the reinforcement. It the two modules are of comparable values, it is also possible to calculate the rigidity more precisely by determining the axis of rotation of the strip in bending and by then calculating its inertia as a function of the position of the axis according to methods that will be familiar to a person skilled in the art. In the most common case, and considering the particular case of a rectangular cross-section for the blade of the reinforcement and the casing, it can be noted that $I_r=(b_r \times h_r^3)/12$ and that $I_e=(b_e \times h_e^3)/12$, where b is the width and h is the height of the blade respectively of the reinforcement and of the casing. In all cases, it is possible to compensate for the variation in the inertia of the cross-section of the casing by a variation of opposite sign of the inertia of the cross-section of the blade, in such a way that the sum of the flexural rigidities remains constant or substantially constant over at least one part of the strip, for example over at least half of the strip.

It is thus possible to proceed according to the following stages in order to determine a geometry of a strap strip, in particular in order to determine a geometry for a reinforcement, and especially in order to determine the width and/or the thickness of the reinforcement for a watch strap strip:

- define a profile for the change in the flexural rigidity of the strip along the strip;
- define a casing material and the dimensions of this casing;
- select the thickness of the reinforcement and the width of the reinforcement, respectively;
- calculate the width of the reinforcement and the thickness of the reinforcement, respectively, in such a way that the flexural rigidity of the strip, along the strip, changes according to the predetermined profile.

In the examples in FIGS. 15 to 17, the casing is of variable width and/or thickness along the strip, and the reinforcement has a variable width depending on its position along the strip, which makes it possible to compensate for the variation in rigidity of the casing alone. FIG. 15 shows a strip of which the casing has a width of 16 mm at one extremity (origin of the x-axis), which remains constant as far as the middle of the strip, and which then increases in a linear fashion to 20 mm at the other extremity of the strip, with a constant thickness of 2.8 mm. FIG. 16 depicts a casing having a constant width along the strip, of which the thickness is 2.8 mm on the first half of the strip and increases linearly up to 3.2 mm. FIG. 17 combines the variations in width and thickness of the strips in FIGS. 15 and 16. The thickness of the reinforcement is chosen to be constant at 0.1 mm, and the initial width is chosen to be 14 mm. The width then varies along the strip in such a way that $(E_r \times I_r + E_e \times I_e)$ remains constant for the length of the strip, where $E_e$=3 MPa (typical value for an elastomer) and $E_r$=80 GPa (typical value for a superelastic alloy, especially a NiTi alloy). It has been established that the variation in the width of the reinforcement makes it possible to compensate advantageously for any dimensional variations in the casing and to achieve a constant rigidity along the strip, associated with enhanced wearing comfort.

In all cases, the profile of the blade along the strip does not change in the same direction as the profile of the casing; that is to say the width of the blade and the width of the casing change in opposite directions along the strip. In other words, the rates of change in the width of the blade and in the width of the casing along the profile have opposite signs. The profile of the blade does not follow the profile of the casing over at least one portion of the strip, for example over at least half of the strip. In more general terms, the rate of variation in the value of the inertia of the cross-section of the blade along the strip is of an opposite sign to the rate of variation in the value of the inertia of the cross-section of the casing over at least one portion of the strip or the reinforcement, for example over at least half of the strip. Thus, the value of the inertia of the cross section of the blade and the value of the inertia of the cross-section of the casing change in opposite directions over at least one portion of the strip or the reinforcement, for example over at least half of the strip.

Similarly, the rate of variation in the thickness value of the blade along the strip may be of a sign opposite to the rate of variation in the thickness value of the casing over at least one portion of the strip or the reinforcement, for example over at least half of the strip. Thus, the thickness value of the blade and the thickness value of the casing may change in opposite directions over at least one portion of the strip or the reinforcement, for example over at least half of the strip.

Similarly, the rate of variation in the width value of the blade along the strip is of an opposite sign to the rate of variation in the thickness value of the casing over at least one portion of the strip or the reinforcement, for example over at least half of the strip. Thus, the width value of the blade and the thickness value of the casing change in opposite directions over at least one portion of the strip or the reinforcement, for example over at least half of the strip.

It should also be noted that the example in FIG. 17 must be considered with caution, because the cross-section of the reinforcement is probably too small at the widest extremity of the casing to ensure the desired mechanical performance. Consideration may be given to a variation in the thickness of the reinforcement in this case, or to not compensating for the variation in inertia of the casing over the entire length of the strip in order not to reduce the cross-section of the reinforcement below the minimum value that ensures the desired mechanical performance.

Thanks to such an architecture, and thanks in particular to the variation in the cross-section of the reinforcement along the strip, it is possible to achieve a desired profile for the flexibility of the strip along its length, especially a constant profile over a portion of the length of the strip or over the entire length of the strip.

In conclusion, the use of a reinforcement with a variable width makes it possible to compensate for the effect of the external geometry of the strip. It even permits a substantial reduction in the effect due to the presence of an element extending below the bottom plane of the strip, such as a comfort cushion.

The area of the strip that is wound around the wrist may thus have an almost constant flexibility and may provide significantly enhanced wearing comfort.

The reinforcement thus has a cross-section of which the geometry, in particular the width of the cross-section, changes along the strip in such a way that the flexural rigidity of the strip, along the strip, has a predetermined profile, in particular a constant profile over at least one portion of the strip, for example over at least half of the strip, for example over the half of the strip close to the closure element. The expression "constant profile" is used here to denote that the flexural rigidity of the strip does not vary by more than 20% of a nominal value, or preferably does not vary by more than 10% of the nominal value, and ideally does not vary by more than 5% of the nominal value.

The casing 3 is made from a polymer material, for example. Polymer materials include the following different families:

thermosetting materials;

elastomers;

thermoplastics.

The most suitable family for an application in a flexible strap is the elastomer family, and possibly the thermoplastic/elastomer family (mixture of elastomers and thermoplastics generally referred to as "TPE"). In order to facilitate the realization of the strap strip, it is generally advantageous to apply a chemical compound to the surface of the metallic reinforcement which promotes the adhesion of the elastomer to the reinforcement. The compound is selected depending on the elastomer and the reinforcement material utilized, for example by consulting the "Product Selector Guide" for Chemlok/Chemosil adhesives published by the LORD company.

Alternatively, the casing may be made from leather stitched around the reinforcement.

The strip has been described previously applied to a strap consisting of two strips and a clasp. In this preferred case, the strip includes a reinforcement extending from the attachment for the watch case to the attachment for the clasp.

It can also be applied to a strap consisting of two strips and another closure element, such as a tongue-buckle system interacting with tongue holes. The strip in this case may include a reinforcement extending from the attachment for the watch case to the attachment for the buckle or a reinforcement extending from the attachment for the watch case to the tongue holes.

In this document, the expression "the linking element 4 mechanically connects or mechanically secures a first fixing element 6 to a second fixing element 5" is used to denote that the linking element prevents the first element from being separated from the second fixing element, other than by breaking the linking element, under a tensile load of 50 N, or 100 N or 200 N. This remains true even before the casing is positioned around the reinforcement.

The invention claimed is:

1. A watch strap strip comprising a casing and a reinforcement housed in the casing, wherein the casing is made from a flexible material, and wherein the reinforcement includes:

a linking element having a first extremity and a second extremity, a first attachment configured for fixing the strap strip to a watch case, wherein the first attachment is mechanically connected or mechanically secured to the first extremity of the linking element, a second attachment configured for fixing the strap strip to a closure element, wherein the second attachment is mechanically connected or mechanically secured to the second extremity of the linking element, wherein the reinforcement has at least one of a higher tensile strength and a lower deformation under stress than the casing, wherein at least one of (i) the first extremity of the linking element is folded and fixed to a central portion of the linking element at the level of the first attachment, and (ii) the second extremity of the linking element is folded and fixed to a central portion of the linking element at the level of the second attachment.

2. The strap strip as claimed in claim 1, wherein the linking element includes a blade.

3. The strap strip as claimed in claim 1, wherein at least one of the first and second attachments is made from a superelastic alloy.

4. The strap strip as claimed in claim 1, wherein at least one of the first and second attachments includes a tube.

5. The strap strip as claimed in claim 1, wherein the linking element is integrally formed with at least one of the first and second attachments.

6. The strap strip as claimed in claim 1, wherein at least one of the folded first extremity and the folded second extremity of the linking element is fixed to the central portion of the linking element by at least one of riveting, soldering and screwing.

7. The strap strip as claimed in claim 1, wherein the linking element is fixed directly to at least one of the first and second attachments.

8. The strap strip as claimed in claim 1, wherein at least one of the first and second attachments is prevented from being separated from the other of the first and second attachments, other than by breaking the linking element, when subjected to a tensile load of 100 N.

9. The strap strip as claimed in claim 8, wherein at least one of the first and second attachments is prevented from being separated from the other of the first and second attachments, other than by breaking the linking element, when subjected to a tensile load of 200 N.

10. The strap strip as claimed in claim 1, wherein the casing is coated or molded onto the reinforcement.

11. The strap strip as claimed in claim 1, wherein at least one of the inertias and the geometries of sections of at least one of the linking element or the casing changes along the strip or the reinforcement in such a way that a flexural rigidity of the strip, along the strip, has a predetermined profile that is constant over at least a part of the strip.

12. The strap strip as claimed in claim 1, wherein characteristic values for at least one of the inertias and the geometries of the sections of the linking element or the blade and the casing change along the strip or the reinforcement in opposite directions.

13. A watch strap including at least one strap strip as claimed in claim 1.

14. A watch including at least one strap strip as claimed in claim 1.

15. A watch strap strip comprising a casing and a reinforcement housed in the casing, wherein the casing is made from a flexible material, and wherein the reinforcement includes:

a linking element having a first extremity and a second extremity, a first attachment configured for fixing the strap strip to a watch case, wherein the first attachment is mechanically connected or mechanically secured to the first extremity of the linking element, a second attachment configured for fixing the strap strip to a closure element, wherein the second attachment is mechanically connected or mechanically secured to the second extremity of the linking element, wherein the reinforcement has at least one of a higher tensile strength and a lower deformation under stress than the casing, wherein the linking element has a cross-section whose geometry changes along the strap strip or the reinforcement, wherein at least one of the widths and thicknesses of the cross-sections of the blade and the casing change along the strap strip in opposite directions.

16. A watch strap strip reinforcement for a strip comprising a casing made from a flexible material, wherein the reinforcement includes a blade made from a superelastic alloy, the blade extending from a first attachment configured for fixing the strap strip to a watch case to a second attachment configured for fixing the strap strip to a closure element, wherein the blade is mechanically connected or mechanically secured directly to at least one of the first and second attachments, wherein the blade is integrally formed with at least one of the first and second attachments, and wherein at least one of (i) the blade includes a first extremity that is folded and fixed to a central portion of the blade at the level of the first attachment, and (ii) the blade includes a second extremity that is folded and fixed to the blade at the level of the second attachment.

17. The reinforcement as claimed in claim 16, wherein at least one of the first and second attachments is made from a superelastic alloy.

18. The reinforcement as claimed in claim 16, wherein at least one of the first and second attachments includes a tube.

19. The reinforcement as claimed in claim 16, wherein at least one of the folded first extremity and the folded second extremity of the blade is fixed to the central portion of the blade by at least one of riveting, soldering and screwing.

20. The reinforcement as claimed in claim 16, wherein the blade is fixed directly to each of the first and second attachments.

21. The reinforcement as claimed in claim 16, wherein at least one of the first and second attachments is prevented from being separated from the other of the first and second attachments, other than by breaking the linking element, when subjected to a tensile load of 100 N.

22. The reinforcement as claimed in claim 21, wherein at least one of the first and second attachments is prevented from being separated from the other of the first and second attachments, other than by breaking the linking element, when subjected to a tensile load of 200 N.

23. A watch strap strip including the reinforcement as claimed in claim 16 and a casing.

24. The reinforcement as claimed in claim 16, wherein the blade is fixed directly to the at least one of the first and second attachments by at least one of riveting, soldering and screwing.

25. A watch strap strip comprising a casing and a reinforcement housed in the casing, wherein the casing is made from a flexible material, wherein the reinforcement includes a blade having a cross-section whose geometry changes along a length of the strap strip, the blade extending from a first attachment configured for fixing the strap strip to a watch case to a second attachment configured for fixing the strap strip to a closure element, wherein the geometry of the cross-section of the blade changes along the length of the strap strip in such a way that the flexural rigidity of the strap strip, along the length of the strap strip, has a predetermined profile that is constant over at least a part of the strap strip, wherein at least one of the widths and thicknesses of the cross-sections of the blade and the casing change along the strap strip in opposite directions.

26. The strap strip as claimed in claim 25, wherein the blade is a metallic blade.

27. The strap strip as claimed in claim 25, wherein at least one of first and second extremities of the blade is fixed directly to at least one of the first and second attachments.

28. A watch strap strip reinforcement for a strip comprising a casing made from a flexible material, wherein the reinforcement includes a blade made from a superelastic alloy, the blade extending from a first attachment configured for fixing the strap strip to a watch case to a second attachment configured for fixing the strap strip to a closure element, wherein the blade is mechanically connected or mechanically secured directly to at least one of the first and second attachments, wherein the blade has a cross-section whose geometry changes along the reinforcement, wherein at least one of the widths and thicknesses of the cross-sections of the blade and the casing change along the strap strip in opposite directions.

29. A watch strap strip comprising a casing and a reinforcement housed in the casing, wherein the casing is made from a flexible material, and wherein the reinforcement includes:

a linking element having a first extremity and a second extremity, a first attachment configured for fixing the strap strip to a watch case, wherein the first attachment is mechanically connected or mechanically secured to the first extremity of the linking element, a second attachment configured for fixing the strap strip to a closure element, wherein the second attachment is mechanically connected or mechanically secured to the second extremity of the linking element, wherein the reinforcement has at least one of a higher tensile strength and a lower deformation under stress than the casing, and wherein the casing includes at least one opening, so that a face of the reinforcement transverse to the opening is visible through the opening.

30. A method for determining at least one of a width and a thickness of a watch strap strip reinforcement for a watch strap strip comprising a casing made from a flexible material, comprising:

defining a profile for a change in a flexural rigidity of the strap strip along the strap strip;

defining a casing material and dimensions of the casing;

selecting a thickness of the reinforcement and a width of the reinforcement, respectively;

calculating at least one of the width of the reinforcement and the thickness of the reinforcement, respectively, in such a way that the flexural of the strap strip, along the strap strip, changes according to the predetermined profile, and providing the watch strap strip according to claim 1, wherein the reinforcement of the watch strap strip has the at least one of the width and the thickness.

* * * * *